US005649701A

United States Patent [19]

Mills et al.

[11] Patent Number: 5,649,701

[45] Date of Patent: Jul. 22, 1997

[54] SPORTS BALL AND METHOD OF MANUFACTURING OF SAME

[75] Inventors: Christopher Mills, Manchester, Great Britain; Jean-Marie Sonntag, Kehl, Germany

[73] Assignee: Umbro UK Limited, Manchester, Great Britain

[21] Appl. No.: 619,757

[22] PCT Filed: Sep. 27, 1994

[86] PCT No.: PCT/GB94/02099

§ 371 Date: Jun. 27, 1996

§ 102(e) Date: Jun. 27, 1996

[87] PCT Pub. No.: WO95/09034

PCT Pub. Date: Apr. 6, 1995

[30] Foreign Application Priority Data

Sep. 29, 1993 [GB] United Kingdom ..... 9320034

[51] Int. Cl.[6] ..... A63B 39/06; A63B 41/08

[52] U.S. Cl. ..... 273/58 BA; 273/58 R; 40/327

[58] Field of Search ..... 273/58 R, 58 A, 273/58 B, 58 BA, 65 R, 65 E, 65 ED, 65 EE, DIG. 14, 233, 235, 60 A, 58 J; 40/327

[56] References Cited

U.S. PATENT DOCUMENTS

| | | | |
|---|---|---|---|
| 2,874,964 | 2/1959 | Edwards | 273/58 R |
| 3,091,562 | 5/1963 | Berlepsch, Jr. et al. | 273/65 EE |
| 3,980,300 | 9/1976 | Hornsby, Jr. | 40/327 |
| 4,234,643 | 11/1980 | Grotefend et al. | 40/327 |
| 4,798,386 | 1/1989 | Berard | 273/235 |
| 4,998,734 | 3/1991 | Meyer | 273/235 |
| 5,320,345 | 6/1994 | Lai et al. | 273/58 BA |

FOREIGN PATENT DOCUMENTS

| | | | |
|---|---|---|---|
| 1711929 | 2/1992 | U.S.S.R. | 273/58 BA |

*Primary Examiner*—Steven S. Wong
*Attorney, Agent, or Firm*—Merchant, Gould, Smith, Edell, Welter & Schmidt, P.A.

[57] ABSTRACT

A sports ball having an inflated or inflatable core (1), an outer covering (12, 13) enclosing the core (11), and a transparent cover layer (14) of transparent film applied to the outer surface of the core covering (12, 13), in which decorative markings (15) are provided at the interface between the internal face of the transparent cover (14) and the outer surface of the outer core covering (12, 13), preferably by application of the markings to the internal face of the transparent cover layer prior to lamination of the various layers of the core covering together. The outer covering on the core (11) may comprise more than one layer (12, 13), and may comprise conventional hand-sewn panels, or may comprise a covering of the non-hand-sewn type. The invention also relates to a method of manufacture of the sports ball.

11 Claims, 3 Drawing Sheets

SPORTS BALL AND METHOD OF MANUFACTURING OF SAME

This invention relates to a sports ball having an inflated or an inflatable core, and an outer covering enclosing the core.

Sports balls most commonly used at present fall into two main categories: those having an external covering of hand-sewn components, foe example of synthetic material such as cloth or non-woven material coated with polyurethane by transfer; and those in which the covering is produced not by a hand sewing operation but by the application of a moulded laminated structure which is generally achieved by mechanical means.

In addition, the classical technique of ball manufacture consists in using an internal bladder, usually of rubber. This is then coated with a cloth component of natural or synthetic fibre or filament, these being for example wound progressively onto the bladder. To ensure the integrity of the filament layer, it is combined with a composition, generally vulcanizable, most Often with a synthetic rubber base. The final exterior covering is then applied on this composition.

It is usually desirable to provide decorative and/or informative markings on the outer covering, such as a supplier's logo. Usually the decorative impressions for these two types of balls referred to above, (hand-sewn and non-hand-sewn), are applied onto the panels, [previously cut out and ready to be assembled or laminated by gluing, in the flat] by silk screening, stamping, or more rarely thermal transfer. The impressions are applied to the outside face of the covering, so as to be directly visible on the finished ball.

The techniques just mentioned are well known in the trade y and therefore do not need to be described in more detail. Whichever category they belong to, hand-sewn or non-hand-sewn, balls do not always give full satisfaction to the makers of branded sports articles. These people are concerned about the life of the decorative impressions (a logo acting as the brand image of a company, or an imprint of a brand name or product name, or pictograms). They are also concerned about the life of the exterior covering, and about the regular sphericity of the ball when new and its stability in use and over time.

To illustrate the unresolved problems for existing manufacture of outdoor and indoor sports at this time, it is sufficient to mention the following:

The decorative impressions appearing on the balls are applied to the outside of the exterior covering, and the known application techniques mentioned above do not permit the application of films sufficiently thick to ensure a life longer than 20 or 25 hours of use. This is not much, considering that a competition ball in soccer, for example, has a life of more than 200 hours. The wear resistance and the adhesion are therefore insufficient. Moreover, the fatty acids or plasticizers used in preparing the pigment mixtures, and other thin layers on the surface such as moisture from the atmosphere or dust, limit and irregularise the adhesion of the decorative printed film. These factors definitely reduce its life. This phenomenon can be clearly observed on a soccer ball, for example, which has been used for fifteen hours or so; the decorative impressions are visible or invisible from one panel to another. Another very well known problem is that of the particularly poor resistance of exterior decorative markings on balls used for indoor sports. Because of the friction caused by the contact of the balls with the surfaces found in multi-sport indoor arenas, the film of marking ink tends to soften due to the heat generated, spread onto the unmarked white surfaces of the ball, and be transferred to the floors of the rooms, producing traces which are difficult to clean. This makes maintenance of the rooms laborious.

Traditional coverings have a limited life as regards their resistance to scratching, Scuffing, cutting, or micro-perforation, and to abrasion, particularly by abrasive ground. These problems substantially impair the appearance of the ball, its watertightness on wet ground, and finally the length of its life. The materials traditionally used as exterior coverings (cloth coated with PVC or polyurethane or various rubber mixtures) all comprise, without exception, a coating support, generally with a synthetic or mixed or natural cloth base, or alternatively a non-woven base. The warp/weft extension of this material, i.e. its extension equilibrium, is totally out of proportion, due to the traction exerted on the warp in the coating process. This equilibrium cannot be controlled or neutralized by the reinforcing cloths subsequently applied by gluing and intended to stabilize the shape and circumference of hand-sewn balls.

According to the invention there is provided a sports ball having an inflated or an inflatable core, and an outer covering enclosing said core, in which a transparent cover layer is applied to the outer surface of said outer covering, and markings are provided at the interface between the internal face of the transparent cover layer and the outer surface of the outer covering, thereby to provide required externally visible markings of the sports ball.

Therefore, in a sports ball according to the invention, any required decorative markings e.g. manufacturer's name, logo or trade mark or other markings, are readily visible through the transparent cover layer, but are protected from wear and tear in service by being located adjacent to the internal face of the transparent cover layer.

Further, the underlying outer core covering is also readily visible through the transparent cover layer, and may therefore be made of any desired one of traditional designs or construction, or indeed other designs and construction as required. The outer core covering therefore may be made of hand-stitched panels, or other (non-hand-stitched) form.

The markings may be applied adjacent to the internal face of the cover layer in any suitable manner, and are then shielded from any damage by being located adjacent to the outer surface of the core covering.

A sports ball according to the invention therefore overcomes the drawbacks associated with existing manufacture of sports balls referred to above and permits the playing of sports and games with these balls, either indoors or outdoors, under conditions which satisfy both users and the firms producing branded sports articles. The balls can retain their decorative markings throughout their working life i.e. until the other parts of the ball are no longer considered usable, and therefore represent a distinct improvement on the sports balls currently available.

Preferably, the markings are provided on the internal face of the transparent cover layer, so as to lie adjacent to the outer surface of the outer covering on the core of the sports ball.

The transparent cover layer may be made from a thermoplastic polymer which is characterized by its transparency and the absence of a coating support, and having extremely good physical and mechanical properties. Because of its transparency, the decorative markings can be applied to the side facing inward, intended to be laminated with the sub-adjacent layers, such as various foams and/or supports of whatever kind. The decorative markings are consequently visible, due to the transparency, on the surface of the ball and are completely protected against any external agency or wear or premature degradation.

To the applicant's knowledge, the use of a transparent exterior covering, without a coating support and having decorative markings facing inward, has never before been proposed for sports balls.

The presence of an exterior layer of transparent material (preferably in the form of a film without a coating support), confers on the internal decorative markings and on the coating, and consequently on the ball itself, entirely advantageous properties and a surprising quality of wear resistance.

In traditional balls the covering is pigmented, usually in white, and is therefore not transparent, and the decorative markings are applied to the outside and on the surface. In contrast, the covering of a sports ball according to the invention is transparent, without coating support, and has good physical and mechanical properties. It allows the decorative markings to be applied to the side of the covering film which faces inward, which is to be laminated with sub-adjacent layers which may be of conventional construction. The printed impressions are visible on the finished ball through the transparent layer.

Because there is no coating support for the exterior covering, the sphericity can be perfectly controlled by applying reinforcing cloths laminated onto the face of the transparent exterior covering with the decorative markings, in the case of hand-sewn balls.

The invention is applicable to all categories of balls and may be used in hand-sewn or non-hand-sewn designs, except that in the case of non-hand-sewn balls, the sphericity is controlled by winding a filament on as previously described.

In the case of a non-hand-sewn soccer ball, the internal core structure consists of a bladder of natural or synthetic rubber, of butyl rubber for example, with a winding of filament attached to a synthetic rubber based composition (e.g. styrene butadiene rubber SBR). To this casing the exterior covering layer is attached by full surface sticking onto the rubber layer. Depending on the design, these layers will be attached to an intermediate i.e. a sub-adjacent layer of a foam or non-woven material, for example. This is to make the structure flexible and facilitate the operations of bevelling or trimming the edges for sticking or joining the panels and to obtain a good appearance.

In the case of a hand-sewn soccer ball, the internal core structure consists of a bladder, of vulcanized natural latex for example. The hand-sewn panels comprise, on the side facing inward, a cloth complex which may have several woven and/or non-woven components. Depending on the design, the transparent exterior covering will be stuck directly onto the cloth complex or attached to an additional subjacent layer, of foam for example, before being laminated to the cloth complex.

In the case of a rugby or handball ball, reference may be made to the foregoing, given that the basic construction of hand-sewn types is similar.

Preferably, the transparent outer cover is formed by a transparent film without coating support and with extremely good physical and mechanical properties, which produces very advantageous results.

A preferred example of transparent film for use as an exterior covering with no coating support, which has proved appropriate to the requirements of the invention, results from the chemistry of polyurethanes of the aromatic ether type and contains UV absorbent agents. By way of example, a transparent polyurethane film which has given excellent results has a thickness of 500 microns and achieves a Shore hardness of 85 points on scale A. Because of its composition and its physical properties as aforesaid, the following advantages are obtained in a sports ball:

- resistance to cryptograms, hydrolytic deterioration, yellowing due to exposure to UV radiation, and accelerated ageing;
- resistance to wear, scuffing, micro-perforation, and cutting; good elastic memory, hence good acceleration of the ball when struck cleanly, no increase in hardness at low temperatures, hence the ball remains flexible to touch and pleasant to the user in winter;
- decorative markings can be applied to the side facing inward due to the transparency of the exterior covering film, hence they last as long as the ball itself;
- better spherical conformation when new and better stability of shape in use and over time, consequently more reliable trajectory and no vibrations when the ball is flying at high speed, and regular, logical, and reliable behaviour in technical or critical phases of the game;
- distinctly longer life, even on very abrasive terrain.

It should be understood that transparent films of different types or different compositions may be used and that the thickness may be reduced to lower the cost of the finished product, but to the detriment of the properties mentioned above. For example, a polyurethane film of the ester type may be used as the exterior covering, although the resistance to microorganisms, the stability to hydrolytic degradation, and the flexibility at low temperatures would be less good. The life of the finished product would consequently be reduced.

The procedure for manufacturing a ball with a transparent exterior covering with decorative markings on the side facing inward, is slightly different than for the manufacture of balls currently available on the market. In existing manufacture, decorative printing is carried out on precut (e.g. of hexagonal or pentagonal configuration), in the flat, by silk screening; stamping, or more rarely thermal transfer. This is done just before the manual cutting stage in the case of a hand-sewn ball, and just before the operations of full-surface sticking onto the framework of non-hand-sewn balls. The marking or printing is carried out with inks based on polyurethane resins, PVC, or acrylic, depending on the type of surface to be marked; or more rarely by means of film based labels, for example of polyurethane on siliconised paper, which can be transferred by the action of heat and pressure using relatively simple electro-pneumatic devices.

In the case of preferred examples of sports ball according to the invention (with a transparent covering with no coating support), having decorative markings on the side facing inward, the marking operation is carried out at a different stage in the construction of the balls. It is carried out on the exterior covering alone, on a large surface, in the flat, with the contours of the cutting-out punch (so as to be able to centre the punch relative to the decorative motifs when cutting out the panels). This is done prior to lamination with the sub-adjacent layers such as foam or cloth complex. These layers facing the inside of the ball are laminated or assembled on the face having the decorative markings, in the case of a hand-sewn ball. In the case of a ball of the non-hand-sewn type, the transparent film used as exterior covering is laminated with a sub-adjacent layer, or not (depending on the design), after the operations of decorative marking; it is then cut out with a punch in the form of panels and stuck full surface onto the core covered with vulcanizable composition. In the case of non-hand-sewn balls, it is also necessary to print the contours of the punches at the same time to allow the decoration to be centred on the panel.

The invention will be further illustrated, without being in any way limited, by the following examples and description, referring to the appended drawings in which.

Figure 3:
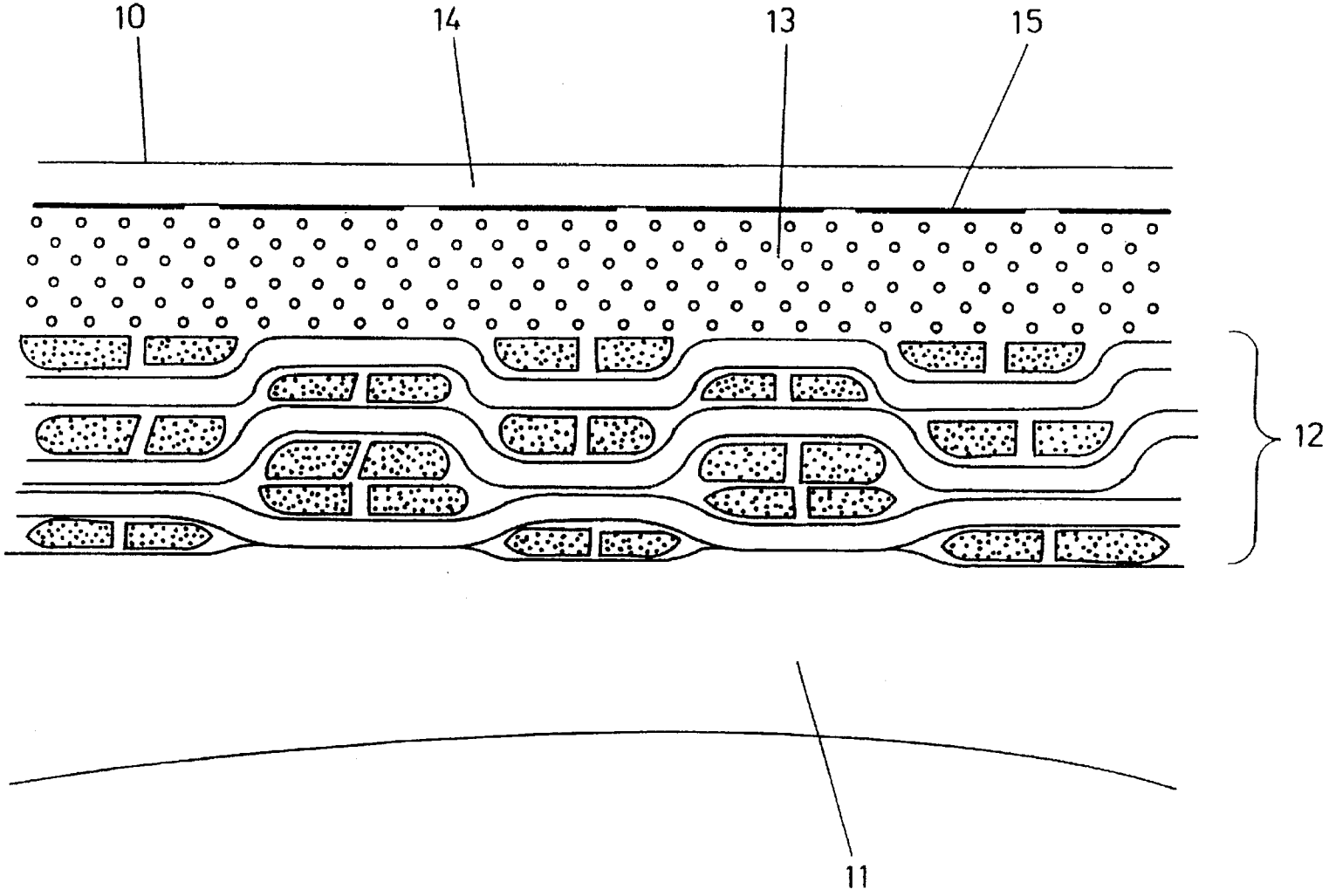
Figure 4:
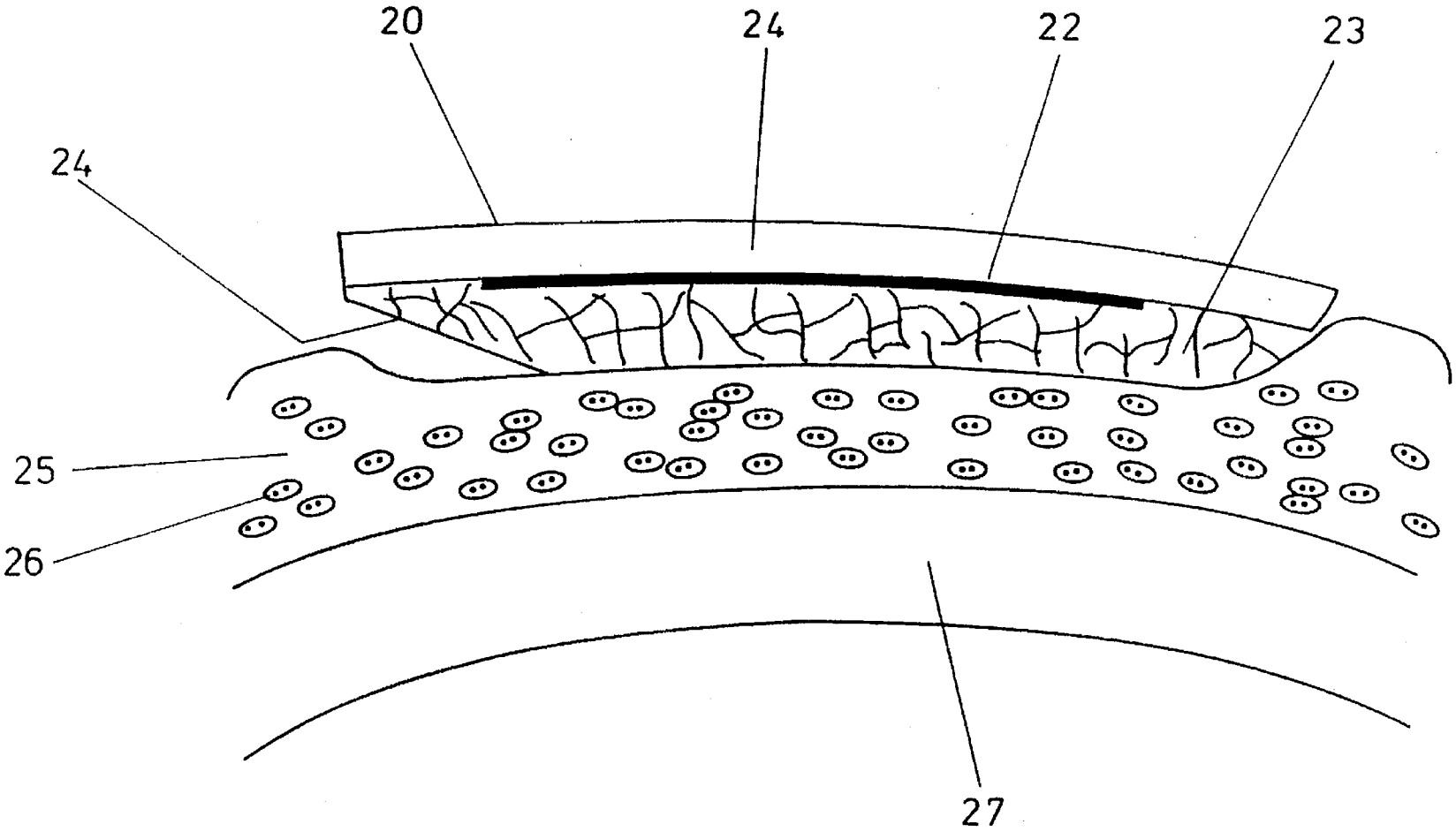

FIG. 3 represents in cross section the outer shell structure of a sports ball according to the invention and in the form of a soccer, rugby, or handball ball, incorporating decorative markings oriented toward the interior of the ball and combined with the transparent exterior covering without coating support; and, FIG. 4 is a view, similar to FIG. 3 of a further embodiment of sports ball according to the invention.

In the following examples the transparent covering film used was a polyurethane film produced by blow moulding with close thickness tolerance with an aromatic ether base, containing UV absorbents, and having a mean thickness of 500

Density of base polymer: 1.14 approx.

Shore A hardness: 85

Melting point (Koffler bench): 145°–55°" C.

Maximum thickness tolerance: ±10%

Figure 1:
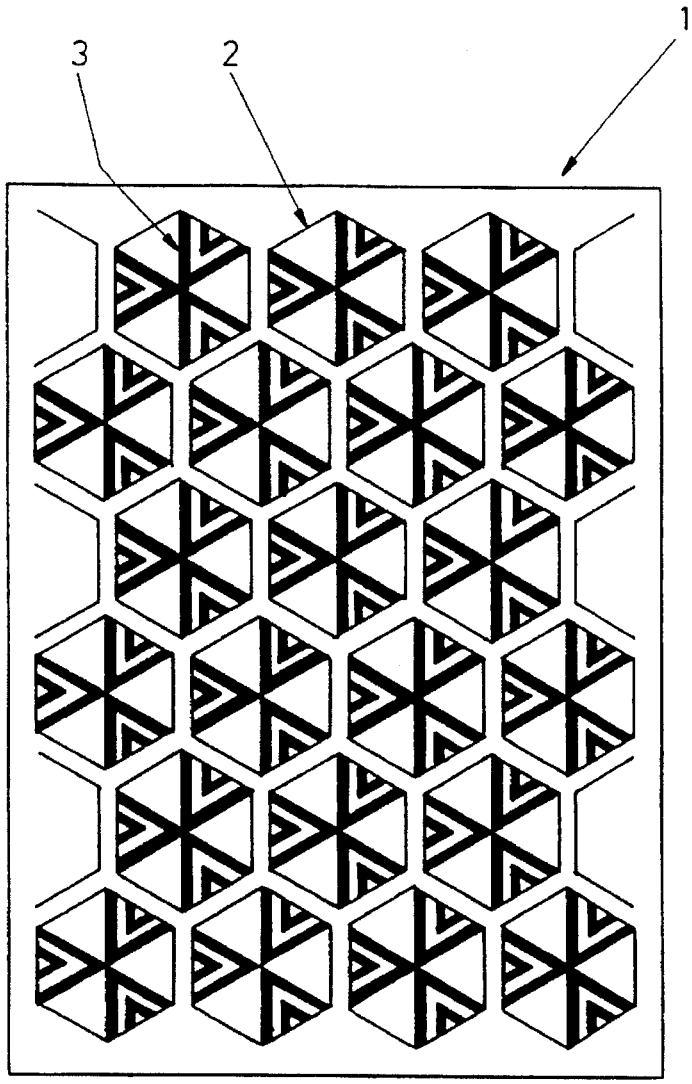
FIG. 1 represents a piece of transparent covering film to form a transparent outer cover of a sports ball according to the invention, having decorative markings applied flat and to a large surface, and at the same time shows the contours of the hexagonal punches, which facilitate positioning the cutting tool and centring the decoration on the underlying panels of the ball core.

FIG. 1 represents a piece of transparent covering, prepared according to the size of surface that it is desired to mark in a single operation and designated by the general reference 1. The decorative markings 3, and the contours 2 of the cutting tool, for example hexagonal as shown in FIG. 1, are imprinted simultaneously on the whole of the surface of the covering piece. This is a preferred means of applying markings to the interface between the internal face of the transparent cover and the outer face of the covering (12, 13) on the core (11) of the sports ball.

Figure 2:
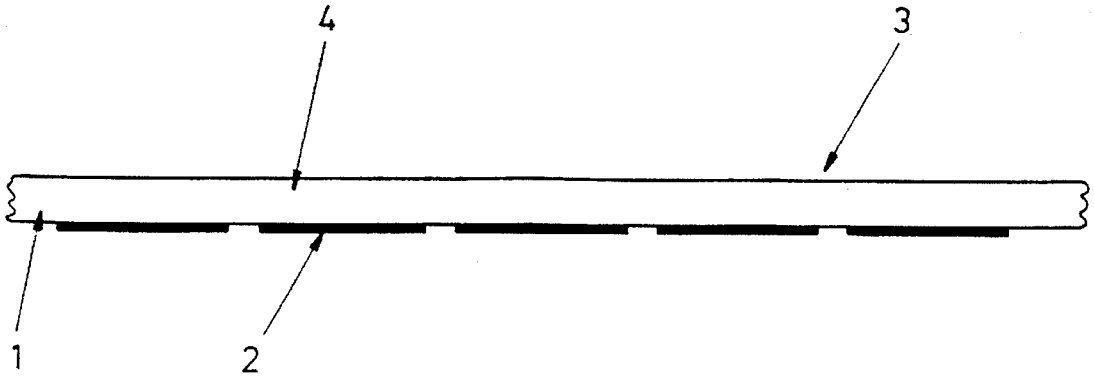
FIG. 2 represents in cross section a piece of transparent covering film for balls, having decorative markings applied by silk screening, for example, and on the side facing the interior of the ball.

FIG. 2 represents in cross section a piece of film or transparent covering for balls, designated by the general reference 3. The reverse side of the transparent film 1 is turned inward and is to receive the sub-adjacent layers. This reverse side bears the decorative markings 2, applied by silk screening, for example, These markings will show through the transparent covering and be visible through the outer side 4, which will form the outside of the finished ball.

FIG. 3 represents in cross section the structure of a soccer, rugby, or handball ball, designated by the general reference 10. The design of these balls is of the hand-sewn type. In their known form, these balls comprise an inflatable bladder core 17, for example of vulcanized latex. To provide dimensional stability, the hand-sewn panels comprise, on the inside, a structure 12 of synthetic fibre cloth. In the example chosen, this structure 12 consists of three layers of cloth. The different layers are bound together by means of adhesive compositions based on dispersions in aqueous media. An exterior covering 14 is composed of a transparent film, on the reverse side of this, which is turned inward and is in direct contact with the sub-adjacent layers, are decorative markings 15, applied before lamination with polyethylene foam 13 (of close cellular structure, cross linked by gamma irradiation) and the reinforcing cloth structure 12. The best results have been obtained using a film without coating support, transparent, composed of thermoplastic polyurethane of the aromatic ether type, with elastomeric behaviour, a thickness of about 500 microns, Shore A hardness 85, produced by blow moulding and containing absorbents of ultraviolet light. Decorative markings of pleasing appearance and satisfactory physical and mechanical properties are generally obtained by the use of two-component polyurethane inks, for example.

FIG. 4 represents in cross section the structure of a soccer or handball ball, designated by the general reference 20. The design of these balls is of the non-hand-sewn type. In their known form, these balls comprise an inflatable bladder 27, of butyl rubber for example, mechanically covered by a multidirectional winding of filament 26, immersed and thereby stabilized in a vulcanizable composition 25. The exterior coating 21 is composed of a transparent film. On the side of this which is turned inward and is in contact with the adjacent layers, are the decorative markings 22 and a non-woven material 23 which serves to provide volume and facilitate sticking to the vulcanizable composition 25. Bevelling or trimming the edge 24 helps obtain a pleasing appearance of the joints of the panels covering the entire surface of the ball.

It has been found that footballs, for example, which have a transparent exterior covering without a coating support, with decorative markings facing inward, achieve a distinctly longer product life with regard to the surface covering and the permanence of decorative markings (which must always show up as clearly as possible in press photos or televised pictures, however long the ball may have been in use). Further, such balls behave in a reliable manner because of their better spherical conformation and their stability of shape, even after very prolonged use and in the course of intensive training in shooting.

Balls produced in this way preserve their pleasing appearance over time, and their properties of watertightness on wet terrain or melting snow. They also maintain their sphericity, on which depends the high-speed flight trajectory and the reliable behaviour of the ball in highly technical or critical phases of the game.

In the foregoing examples of the invention the outer cover is formed by a thermoplastic polyurethane film with elastomeric properties, an aromatic ether base, and a thickness of 500 microns. This is produced by blow moulding and its hardness on the Shore A scale is 85 points. Of course, comparable results can be obtained with materials of different types and physical properties, produced by other processes such as calendaring or transfer coating and having a different thickness (this may be reduced to about 200 microns). The materials may be modified in varying degrees according to whether the balls are to be used indoors or outdoors, the type of ball being designed, and the type of ground (grass, hard ground, packed earth).

We claim:

1. A method of manufacture of a sports ball having an inflatable core comprising the steps of:

a) providing a transparent cover layer having an inward and outward side;

b) applying decorative marking to said inward side of the transparent cover layer;

c) laminating sub-adjacent layers to said inward side;

d) cutting the material with a punch to form panels;

e) joining or assembling the panels together; and f) applying the assembled cover to said inflatable core with said outward side of said transparent cover layer outermost.

2. A method according to claim 1 in which said decorative markings are applied to said transparent cover layer with said transparent cover layer as a flat layer.

3. A method according to claim 2 in which said sub-adjacent layers are laminated on to said transparent cover layer using adhesives.

4. A method according to claim 1 in which said decorative markings are applied by silk screen printing.

5. A method according to claim 1 in which said transparent cover layer comprises a polyurethane film produced by blow molding.

6. A method according to claim 1 in which said transparent cover layer is produced from polyurethane with an aromatic ether base.

7. A method according to claim 1 in which said transparent cover layer is produced for polyurethane with an ether base.

8. A method according to claim 2 in which said decorative markings are applied to said transparent cover layer along with contours, said contours defining the boundary of the panels to be punched.

9. A method according to claim 3 in which said sub-adjacent layers comprise one or more fibre cloth layers and one or more foam layers laminated together.

10. A method according to claim 9 in which said sub-adjacent layer next to the said transparent cover layer is a polyethylene foam layer.

11. A sports ball manufactured according to the method of claim 1.

* * * * *